US010625964B2

(12) United States Patent
Terakado et al.

(10) Patent No.: US 10,625,964 B2
(45) Date of Patent: Apr. 21, 2020

(54) PAPER FEED DEVICE

(71) Applicant: RISO KAGAKU CORPORATION, Tokyo (JP)

(72) Inventors: Ryo Terakado, Ibaraki (JP); Yukihiro Maeda, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 16/205,581

(22) Filed: Nov. 30, 2018

(65) Prior Publication Data

US 2019/0161295 A1 May 30, 2019

(30) Foreign Application Priority Data

Nov. 30, 2017 (JP) ..... 2017-230509

(51) Int. Cl.
*B65H 3/06* (2006.01)
*B65H 7/02* (2006.01)
(Continued)

(52) U.S. Cl.
CPC ..... *B65H 3/0669* (2013.01); *B41J 11/04* (2013.01); *B65H 1/08* (2013.01); *B65H 1/14* (2013.01);
(Continued)

(58) Field of Classification Search
CPC ..... B65H 1/08; B65H 1/14; B65H 3/0607; B65H 3/0669; B65H 7/02; B65H 7/18;
(Continued)

(56) References Cited

U.S. PATENT DOCUMENTS 7,334,787 B2 2/2008 Akiyama et al.
8,857,809 B2 10/2014 Toyooka et al.
(Continued)

FOREIGN PATENT DOCUMENTS

CN 1477470 A 2/2004
CN 103662885 A 3/2014
(Continued)

OTHER PUBLICATIONS

Feb. 3, 2020 counterpart Chinese application No. 201811453312.2.

*Primary Examiner* — David H Bollinger
(74) *Attorney, Agent, or Firm* — Greenblum & Bernstein, P.L.C.

(57) ABSTRACT

A controller performs a positioning operation by driving an elevator motor before starting a paper feed operation using a paper feed roller unit. While the controller performs the paper feed operation using the paper feed roller unit after an upper limit sensor is brought into an on-state by the positioning operation, when the upper limit sensor is brought into an off-state, the controller performs a paper feed position following operation by driving the elevator motor to raise a paper feed tray until the upper limit sensor is brought into the on-state. The controller controls the elevator motor with setting a current limit in the positioning operation such that a current flowing to the elevator motor does not exceed a predetermined current limit value and controls the elevator motor without the current limit in the paper feed position following operation.

3 Claims, 6 Drawing Sheets

(51) Int. Cl.

| | |
|---|---|
| ***B65H 1/08*** | (2006.01) |
| ***B41J 11/04*** | (2006.01) |
| ***B65H 7/04*** | (2006.01) |
| ***B65H 1/14*** | (2006.01) |

(52) U.S. Cl.
CPC ..... *B65H 3/0684* (2013.01); *B65H 7/02* (2013.01); *B65H 7/04* (2013.01); *B65H 2511/515* (2013.01); *B65H 2513/40* (2013.01)

(58) Field of Classification Search
CPC ..... B65H 2403/92; B65H 2511/52; B65H 2515/704
See application file for complete search history.

(56) References Cited

U.S. PATENT DOCUMENTS

| | | | | |
|---|---|---|---|---|
| 9,260,260 | B2 | 2/2016 | Park et al. | |
| 2003/0184002 | A1* | 10/2003 | Akiyama ..... | B65H 3/0669 271/110 |
| 2010/0133745 | A1* | 6/2010 | Ikeuchi ..... | B65H 1/14 271/265.04 |

FOREIGN PATENT DOCUMENTS

| | | | |
|---|---|---|---|
| CN | 203529504 | U | 4/2014 |
| CN | 104811572 | A | 7/2015 |
| JP | 07-228390 | A | 8/1995 |
| JP | 7-277551 | A | 10/1995 |

* cited by examiner

PAPER FEED DEVICE

CROSS REFERENCE TO RELATED APPLICATION

This application claims benefit of priority under 35 U.S.C. § 119 to Japanese Patent Application No. 2017-230509, filed on Nov. 30, 2017, the entire contents of which are incorporated by reference herein.

BACKGROUND OF THE INVENTION

1. Field of the Invention

The present invention relates to a paper feed device that feeds paper.

2. Description of the Related Art

There has been known a paper feed device that is provided on a printing machine and feeds paper to a print unit by picking up a sheet of paper one by one on the top of a bundle of paper placed on a paper feed tray using a paper feed roller (refer to Patent Literature 1: Japanese Patent Application Laid-Open No. H07-277551, for example).

Such a paper feed device has the paper feed tray configured to be raised and lowered. When the paper feed device feeds paper, the paper feed tray is raised until a top position of the bundle of paper on the paper feed tray reaches a paper feed position that is a height position to allow the paper feed roller to pick up a sheet of paper. During a paper feed operation, a paper feed position following operation is performed, which is to keep the top position of the bundle of paper on the paper feed tray at the paper feed position by raising the paper feed tray according to the progress of the paper feed operation. While the paper feed tray is raised, when an upper limit sensor detects that the top position of the bundle of paper on the paper feed tray is at the paper feed position, an elevator motor raising the paper feed tray is stopped.

While the paper feed tray is raised, there is a possibility of an abnormality that although the top position of the bundle of paper reaches the paper feed position, the elevator motor is kept driven due to a trouble in the upper limit sensor or the like.

When such an abnormality occurs, the bundle of paper bumps against the paper feed roller or the like, and thus the paper feed tray is prevented from being raised. The elevator motor however tries to keep rotating. As a result, damage may occur to the device. Specifically, damage may occur to a gear included in a driving mechanism for raising and lowering the paper feed tray by transmitting the driving force of the elevator motor to the paper feed tray.

SUMMARY OF THE INVENTION

As a method to prevent such damage of the gear, there is a method to set a current limit on the elevator motor using a constant current control function that the motor driver has. That is, a current limit is set on the elevator motor such that torque generated by the elevator motor is controlled to a degree not to damage the gear. This controls the torque generated by the elevator motor to a degree not to damage the gear, even if the elevator motor tries to keep rotating while the paper feed tray is prevented from being raised. Accordingly, the above-described damage of the gear is prevented.

As described above, setting of the current limit on the elevator motor controls the generation of torque by the elevator motor. As a result, the speed of raising the paper feed tray is restricted. This may cause a trouble in the paper feed because raising of the paper feed tray in the paper feed position following operation may not compensate for descending of the top position of the bundle of paper on the paper feed tray by the paper feed operation. In particular, a paper feed device provided on a printing machine having high productivity in printing conspicuously has the above-described paper feed trouble, as the descending speed of the top position of the bundle of paper on the paper feed tray by the paper feed operation is high.

An object of the present invention is to provide a paper feed device that prevents the device from being damaged and prevents the trouble in paper feed.

To achieve the above-described object, according to a first aspect of the present invention, there is provided a paper feed device including: a paper feed tray that is raised and lowered, on which a plurality of sheets of paper is placed; a paper feed roller that picks up a sheet of paper on the top of a bundle of paper on the paper feed tray; a detector that detects that a top position of the bundle of paper on the paper feed tray is at a predetermined paper feed position; a motor that generates a driving force for raising and lowering the paper feed tray; a driving mechanism that transmits the driving force of the motor to the paper feed tray to raise and lower the paper feed tray; and a controller that (i) when starting a paper feed operation to pick up the sheet of paper one by one from the bundle of paper on the paper feed tray by the paper feed roller, drives the motor to perform a positioning operation to raise the paper feed tray from when the detector is in an off-state where the detector does not detect that the top position of the bundle of paper on the paper feed tray is at the paper feed position till the detector is brought into an on-state in which the detector detects that the top position of the bundle of paper on the paper feed tray is at the paper feed position, and (ii) while performing the paper feed operation using the paper feed roller after the detector is brought into the on-state by the positioning operation, when the detector is brought into the off-state, drives the motor to perform a paper feed position following operation to raise the paper feed tray until the detector is brought into the on-state, wherein the controller controls the motor by setting a current limit in the positioning operation such that a current flowing to the motor does not exceed a current limit value and the controller controls the motor without setting the current limit in the paper feed position following operation.

According to a second aspect of the present invention, there is provided a paper feed device including: a paper feed tray that is raised and lowered, on which a plurality of sheets of paper is placed; a paper feed roller that picks up a sheet of paper on the top of a bundle of paper on the paper feed tray; a detector that detects that a top position of the bundle of paper on the paper feed tray is at a predetermined paper feed position; a motor that generates a driving force for raising and lowering the paper feed tray; a driving mechanism that transmits the driving force of the motor to the paper feed tray to raise and lower the paper feed tray; and a controller that, when starting a paper feed operation to pick up the sheet of paper one by one from the bundle of paper on the paper feed tray by the paper feed roller, drives the motor to perform a positioning operation to raise the paper feed tray from when the detector is in an off-state where the detector does not detect that the top position of the bundle of paper on the paper feed tray is at the paper feed position till the detector is brought into an on-state in which the detector detects that the top position of the bundle of paper on the paper feed tray is at the paper feed position, wherein the controller controls the motor by setting a current limit in the positioning operation such that a current flowing to the motor does not exceed a current limit value.

According to the paper feed device of the present invention, it is possible to prevent the device from being damaged and to prevent the trouble in paper feed.

DESCRIPTION OF THE EMBODIMENTS

Figure 1:
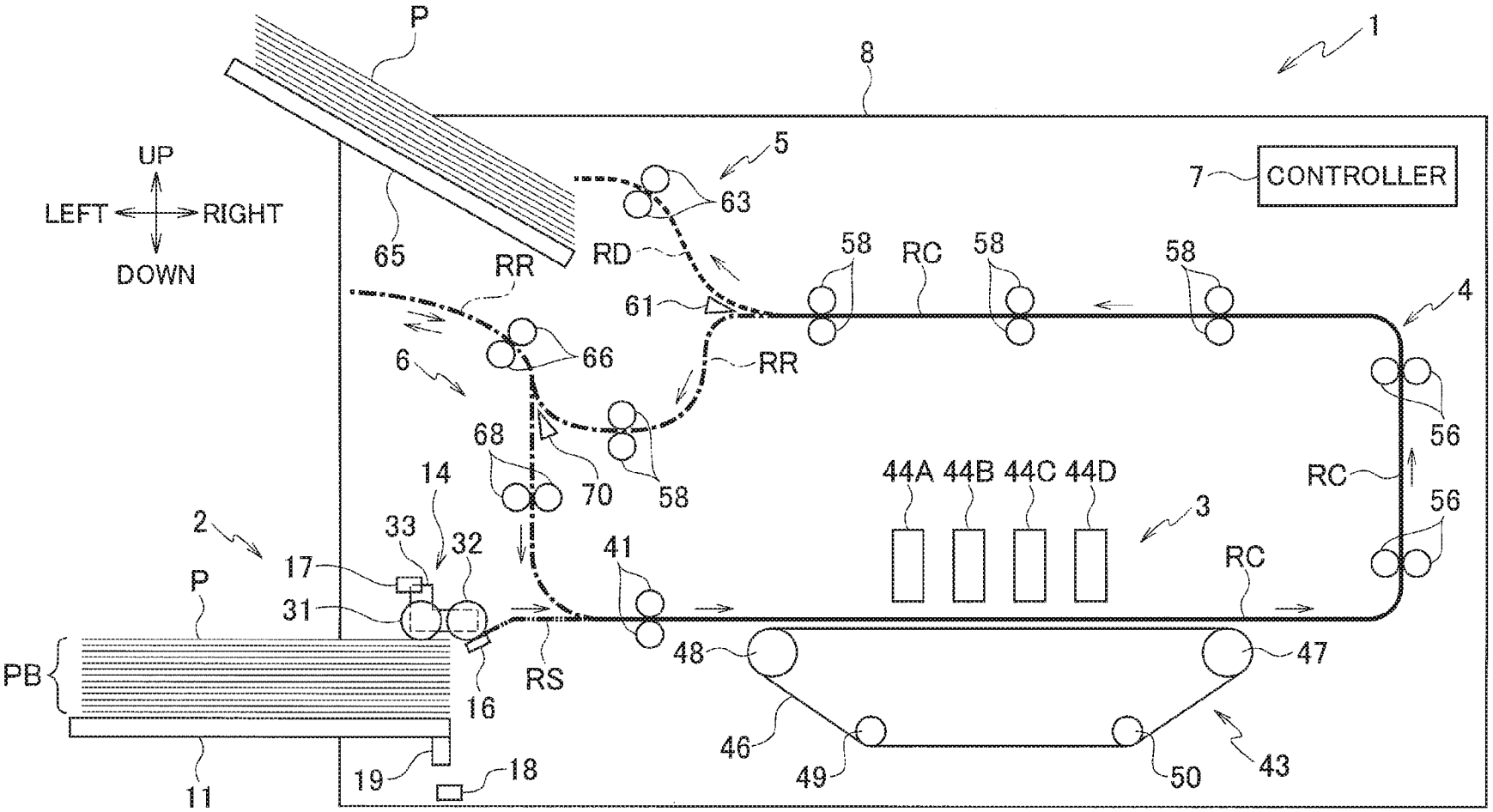
FIG. 1 is a diagram illustrating a schematic configuration of a printing machine provided with a paper feed device according to an exemplary embodiment of the present invention.

An exemplary embodiment of the present invention will be described below with reference to the accompanying drawings. In the drawings, the same or similar reference symbol is attached to the same or similar part or structural element.

The below-described exemplary embodiment presents an example of an apparatus and the like for realizing the technical concept of the present invention. The technical concept of the present invention regarding a material, a shape, a configuration, an arrangement and the like of each structural component is not limited to the embodiment. Various modifications can be made in the technical concept of the present invention within the scope of claims.

Figure 2:
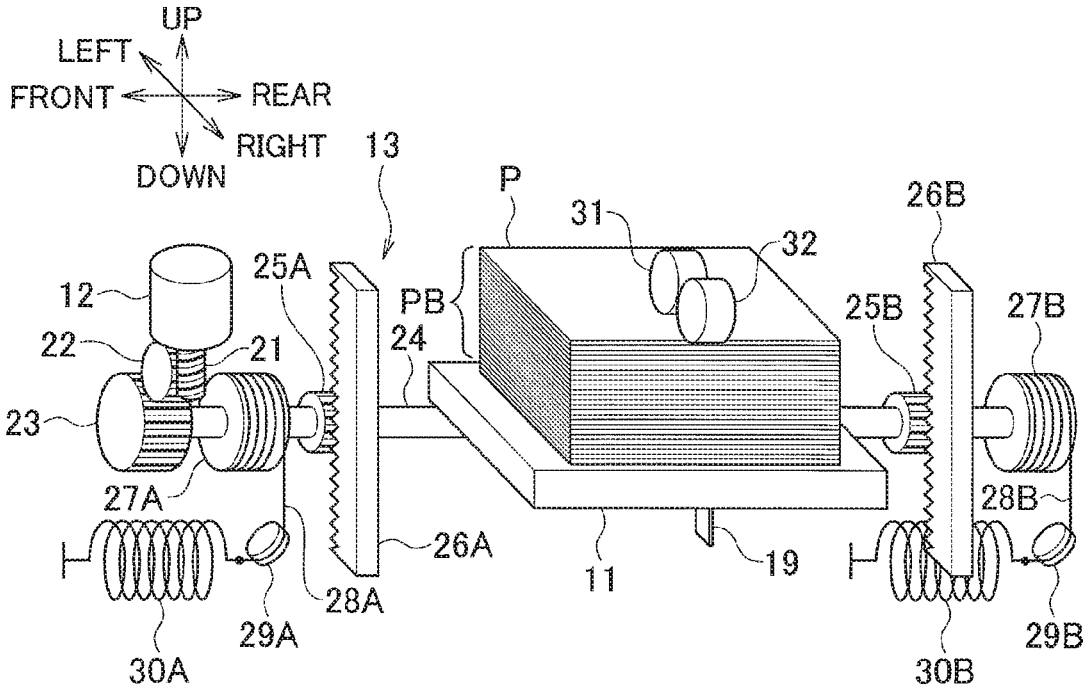
FIG. 2 is a perspective view of a schematic configuration of a driving mechanism for raising and lowering a paper feed tray of the printing machine shown in FIG. 1.
Figure 3:
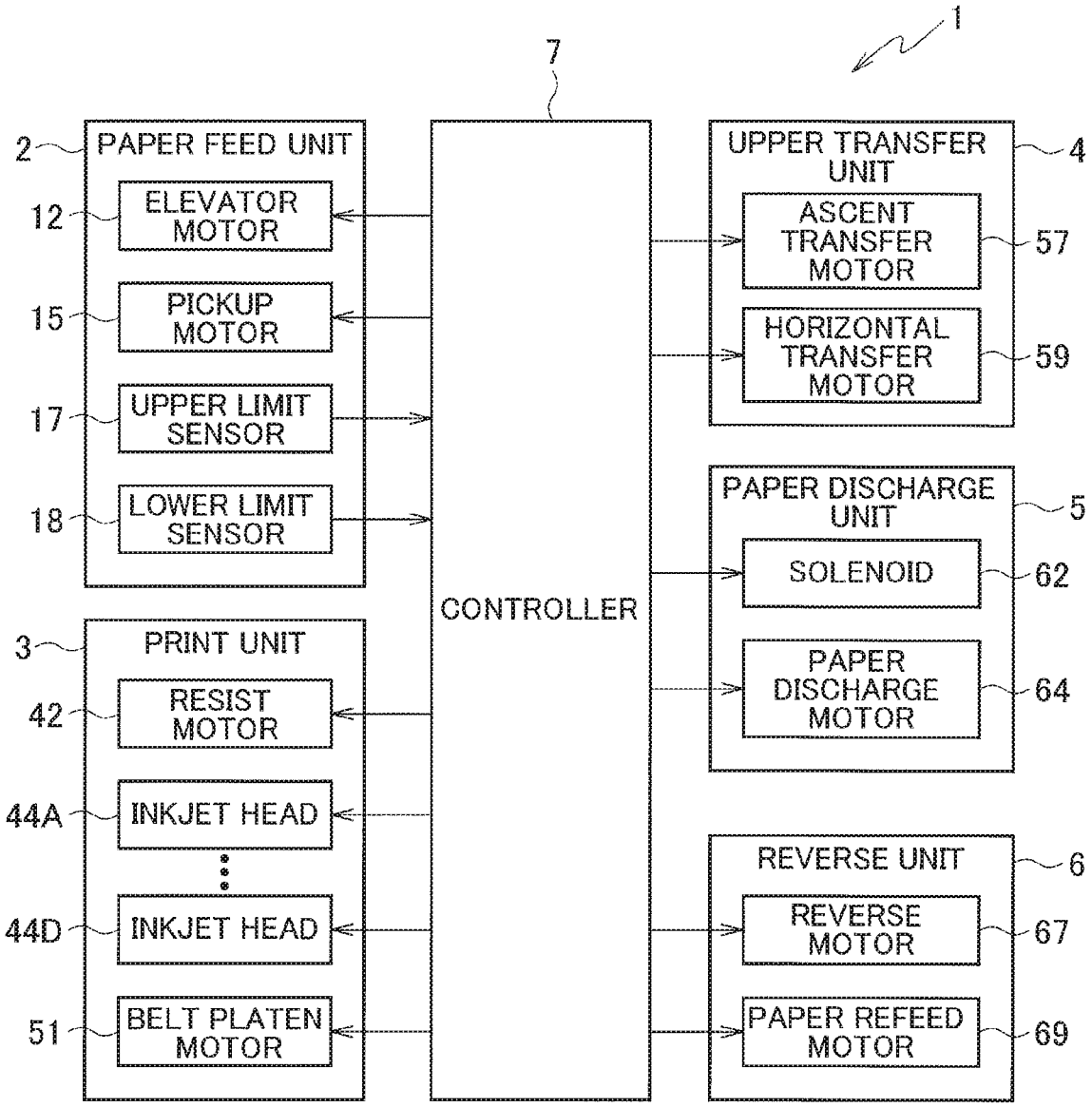
FIG. 3 is a control block diagram illustrating the printing machine shown in FIG. 1.
Figure 4:
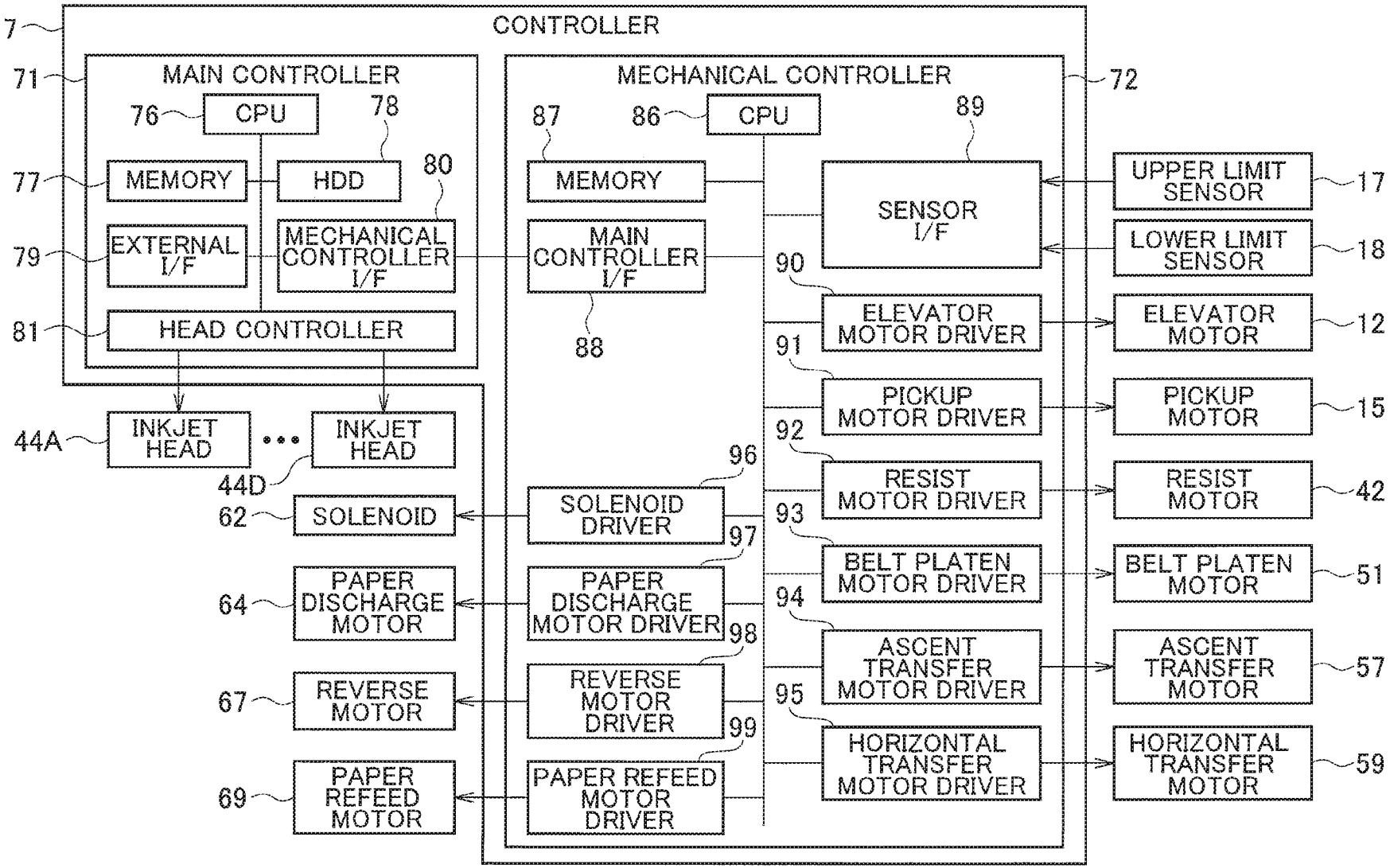
FIG. 4 is a block diagram illustrating a configuration of a controller shown in FIG. 1.

FIG. 1 is a diagram illustrating a schematic configuration of a printing machine provided with a paper feed device according to an exemplary embodiment of the present invention. FIG. 2 is a perspective view of a schematic configuration of a driving mechanism for raising and lowering a paper feed tray of the printing machine shown in FIG. 1. FIG. 3 is a control block diagram illustrating the printing machine shown in FIG. 1. FIG. 4 is a block diagram illustrating a configuration of a controller shown in FIG. 1. It is noted that a direction orthogonal to the sheet of FIG. 1 is defined as front and rear directions where a direction from the surface of the sheet is defined as the front in the following explanation. Moreover, the top and bottom and the left and right of the sheet of FIG. 1 are defined as up and down directions and left and right directions, respectively.

Routes shown in bold lines in FIG. 1 are transfer routes on which a sheet of paper as a printing medium is to be transferred. Among the transfer routes, a route shown in a solid line is a common route RC, a route shown in a dashed dotted line is a reverse route RR, a route shown in a dashed line is a paper discharge route RD, and a route shown in a dashed double-dotted line is a paper feed route RS. Upstream and downstream in the following description mean upstream and downstream on the transfer routes.

As shown in FIGS. 1 and 3, a printing machine 1 according to the present exemplary embodiment includes a paper feed unit 2, a print unit 3, an upper transfer unit 4, a paper discharge unit 5, a reverse unit 6, a controller 7, and a housing 8 to store or hold each unit. It is noted that the paper feed device according to the present exemplary embodiment includes the paper feed unit 2 and the controller 7.

The paper feed unit 2 feeds a sheet of paper P to the print unit 3. As shown in FIGS. 1 to 3, the paper feed unit 2 includes a paper feed tray 11, an elevator motor (motor) 12, a driving mechanism 13, a paper feed roller unit 14, a pickup motor 15, a stripper plate 16, an upper limit sensor (detector) 17, and a lower limit sensor 18.

The sheet of paper P is placed on the paper feed tray 11. The paper feed tray 11 is configured to be raised and lowered. A blocking plate 19 is arranged on the undersurface of the paper feed tray 11 in a standing condition. The lower limit sensor 18 detects the blocking plate 19 when the paper feed tray 11 is at a lower limit position.

The elevator motor 12 generates driving force for raising and lowering the paper feed tray 11. The driving force of the elevator motor 12 is transmitted to the paper feed tray 11 by the driving mechanism 13, so that the paper feed tray 11 is raised and lowered. Driving of the elevator motor 12 in a forward direction raises the paper feed tray 11, and that in a reverse direction lowers the paper feed tray 11.

The driving mechanism 13 transmits the driving force of the elevator motor 12 to the paper feed tray 11, thereby raising and lowering the paper feed tray 11. As shown in FIG. 2, the driving mechanism 13 includes a worm gear 21, an idler gear 22, a shaft gear 23, a shaft 24, pinions 25A, 25B, racks 26A, 26B, winding pulleys 27A, 27B, wires 28A, 28B, direction change pulleys 29A, 29B, and assist springs 30A, 30B.

The worm gear 21 rotates the idler gear 22 by the driving force of the elevator motor 12. The worm gear 21 is mounted on a motor shaft of the elevator motor 12 and meshes with the idler gear 22.

The idler gear 22 meshes with the worm gear 21 and the shaft gear 23 to transmit the driving force of the elevator motor 12 from the worm gear 21 to the shaft gear 23.

The shaft gear 23 is rotated by the driving force of the elevator motor 12, which is transmitted by the idler gear 22, and thus rotates the shaft 24. The shaft gear 23 is fixed on a front end of the shaft 24.

The shaft 24 is connected to the paper feed tray 11 and is raised and lowered by a rack and pinion mechanism including the pinions 25A, 25B and the racks 26A, 26B, thereby raising and lowering the paper feed tray 11. The shaft 24 is provided such that an axial direction thereof is parallel to the front and rear directions.

The pinions 25A, 25B mesh with rack teeth of the racks 26A, 26B, respectively, and rotate with the shaft 24, thereby ascending and descending along the racks 26A, 26B. The pinions 25A, 25B are arranged apart in the front and rear directions such that the paper feed tray 11 is located between the pinions 25A, 25B, and are fixed on the shaft 24. The pinions 25A, 25B ascend when rotating in a clockwise direction viewed from the front. On this occasion, the shaft 24 ascends, so that the paper feed tray 11 is raised. The pinions 25A, 25B descend when rotating in a counterclockwise direction viewed from the front. On this occasion, the shaft 24 descends, so that the paper feed tray 11 is lowered.

The racks 26A, 26B are in linear stick shapes and provided with rack teeth to mesh with the pinions 25A, 25B, respectively. The racks 26A, 26B are arranged apart in the front and rear directions such that the paper feed tray 11 is located between the racks 26A, 26B, and are at positions where the rack teeth mesh with the pinions 25A, 25B, respectively.

The wires 28A, 28B are wound around the winding pulleys 27A, 27B, respectively. The winding pulley 27A is fixed to the shaft 24 between the shaft gear 23 and the pinion 25A. The winding pulley 27B is fixed to a rear end of the shaft 24.

The wires 28A, 28B transmit pulling forces of the assist springs 30A, 30B to the winding pulleys 27A, 27B, respectively.

The direction change pulleys 29A, 29B change directions of the wires 28A, 28B between the winding pulleys 27A, 27B and the assist springs 30A, 30B, respectively.

The assist springs 30A, 30B are pulling springs to assist the elevator motor 12 when the paper feed tray 11 is raised. The assist springs 30A, 30B have one ends connected to the wires 28A, 28B, respectively, and the other ends connected to fixation members (not shown) in the printing machine 1, respectively. Pulling forces of the assist springs 30A, 30B work as rotation forces to rotate the shaft 24 through the winding pulleys 27A, 27B, respectively, in a clockwise direction viewed from the front. This reduces torque of the elevator motor 12 for rotating the shaft 24 when the paper feed tray 11 is raised.

A bundle of paper PB is made of a plurality of sheets of paper P placed on the paper feed tray 11. The paper feed roller unit 14 picks up a sheet of paper P on the top of the bundle of paper PB on the paper feed tray 11 to transfer toward the print unit 3 along the paper feed route RS. The paper feed roller unit 14 includes a scraper roller (paper feed roller) 31, a pickup roller 32, and a blocking plate 33.

The scraper roller 31 press-contacts with the sheet of paper P at the uppermost position (the highest) among the sheets of paper P placed on the paper feed tray 11, picks up the sheet of paper P by frictional force, and transfers the sheet of paper P to the right. When a top position (height position of the uppermost sheet of paper P on the paper feed tray 11) of the bundle of paper PB on the paper feed tray 11 is at a predetermined paper feed position, the scraper roller 31 is given a paper feed pressure possible to pick up the uppermost sheet of paper P. The scraper roller 31 moves upward and downward to a certain extent according to fluctuations of the position (height) of the uppermost sheet of paper P. When the position of the uppermost sheet of paper P is lower than the paper feed position, the paper feed pressure decreases, and the scraper roller 31 easily spins round.

The pickup roller 32 handles the sheet of paper P, which is transferred by the scraper roller 31, between the pickup roller 32 and the stripper plate 16 to transfer the sheet of paper P to the right. The pickup roller 32 is arranged adjacent to the scraper roller 31 at the right of the scraper roller 31.

The blocking plate 33 is provided for the upper limit sensor 17 detecting that the top position of the bundle of paper PB on the paper feed tray 11 is at the paper feed position. The paper feed position is a position set as a height position of the uppermost sheet of paper P when the scraper roller 31 picks up the uppermost sheet of paper P on the paper feed tray 11. The blocking plate 33 swings around a rotation axis of the pickup roller 32 according to the upward and downward movements of the scraper roller 31.

The pickup motor 15 rotates to drive the pickup roller 32. The rotation driving force of the pickup motor 15 is transmitted from the pickup roller 32 to the scraper roller 31 by a driving force transmission mechanism (not shown). Accordingly, the scraper roller 31 rotates with the pickup roller 32.

The stripper plate 16 handles the sheet of paper P such that the pickup roller 32 transfers the sheet of paper P one by one. The stripper plate 16 press-contacts with the pickup roller 32 from under the pickup roller 32.

The upper limit sensor 17 detects that the top position of the bundle of paper PB on the paper feed tray 11 is at the paper feed position. The upper limit sensor 17 is formed with a concave portion on the right thereof and is formed in an approximate U-shape having an opening on the right viewed from the top. In the concave portion, a light emitting device and a light receiving sensor are arranged to face each other. The blocking plate 33 of the paper feed roller unit 14 is inserted into the concave portion. The upper limit sensor 17 detects the blocking plate 33 when a light emitted from the light emitting device is blocked by the blocking plate 33 and the light receiving sensor does not receive the light from the light emitting device. The upper limit sensor 17 is arranged to detect the blocking plate 33 when the uppermost sheet of paper P on the paper feed tray 11 is at the paper feed position. When the uppermost sheet of paper P is lower than the paper feed position, the left part of the blocking plate 33 goes down with the scraper roller 31. On this occasion, the upper limit sensor 17 does not detect the blocking plate 33.

A state in which the upper limit sensor 17 detects the blocking plate 33 and detects that the top position of the bundle of paper PB on the paper feed tray 11 is at the paper feed position is defined as the on-state. A state in which the upper limit sensor 17 does not detect the blocking plate 33 and does not detect that the top position of the bundle of paper PB on the paper feed tray 11 is at the paper feed position is defined as the off-state.

The lower limit sensor 18 detects that the paper feed tray 11 is at a predetermined lower limit position. The lower limit sensor 18 has a configuration like the above-described upper limit sensor 17 and is arranged in an approximate U-shape having an opening on the left viewed from the top. The lower limit sensor 18 detects the blocking plate 19 provided on the paper feed tray 11 when the paper feed tray 11 is at the lower limit position. A state in which the lower limit sensor 18 detects the blocking plate 19 and detects that the paper feed tray 11 is at the lower limit position is defined as an on-state. A state in which the lower limit sensor 18 does not detect the blocking plate 19 and does not detect that the paper feed tray 11 is at the lower limit position is defined as an off-state.

While transferring the sheet of paper P fed from the paper feed unit 2, the print unit 3 performs printing on the sheet of paper P. The print unit 3 includes a pair of resist rollers 41, a resist motor 42, a belt platen unit 43, and inkjet heads 44A to 44D.

The resist rollers 41 once stop the sheet of paper P transferred by the paper feed roller unit 14 and then transfers the sheet of paper P toward the belt platen unit 43. The resist rollers 41 are arranged on the common route RC near a joining point of the paper feed route RS and the reverse route RR.

The resist motor 42 rotates to drive the resist rollers 41.

The belt platen unit 43 transfers the sheet of paper P transferred from the resist rollers 41 under the inkjet heads 44A to 44D. The belt platen unit 43 includes a transfer belt 46, a driving roller 47, driven rollers 48 to 50, and a belt platen motor 51.

The transfer belt 46 is an annular belt put across the driving roller 47 and the driven rollers 48 to 50. The transfer belt 46 is provided with a plurality of belt holes over the entire surface thereof, which are penetration holes for suction and holding of the sheet of paper P. The transfer belt 46 sucks and holds the sheet of paper P on the surface thereof by a suction force generated to the belt holes by driving a fan (not shown). Driving of the driving roller 47 rotates the transfer belt 46 in a clockwise direction in FIG. 1. The transfer belt 46 moves in an endless manner to transfer the sheet of paper P to the right, which is sucked and held thereon.

The driving roller 47 and the driven rollers 48 to 50 support the transfer belt 46. The driving roller 47 rotates the transfer belt 46. The driven rollers 48 to 50 follow the driving roller 47 to be rotated through the transfer belt 46.

The belt platen motor 51 rotates to drive the driving roller 47.

The inkjet heads 44A to 44D discharge ink drops to form an image on the sheet of paper P transferred by the belt platen unit 43.

The upper transfer unit 4 transfers the sheet of paper P transferred from the belt platen unit 43 to the paper discharge unit 5 or the reverse unit 6. The upper transfer unit 4 includes plural pairs of ascent transfer rollers 56, an ascent transfer motor 57, plural pairs of horizontal transfer rollers 58, and a horizontal transfer motor 59.

The ascent transfer rollers 56 transfer the sheet of paper P transferred by the belt platen unit 43 upward to the horizontal transfer rollers 58. The ascent transfer rollers 56 are arranged along an ascent portion in the midstream area of the common route RC.

The ascent transfer motor 57 rotates to drive the plural pairs of ascent transfer rollers 56.

The horizontal transfer rollers 58 transfer the sheet of paper P transferred from the ascent transfer rollers 56 to the paper discharge unit 5 or the reverse unit 6. A most downstream pair of horizontal transfer rollers 58 among the plural pairs of horizontal transfer rollers 58 is arranged in the upstream area of the reverse route RR. Other pairs of horizontal transfer rollers 58 are arranged at a horizontal portion in the downstream area of the common route RC.

The horizontal transfer motor 59 rotates to drive the plural pairs of horizontal transfer rollers 58.

The paper discharge unit 5 discharges the printed sheet of paper P. The paper discharge unit 5 includes a switch portion 61, a solenoid 62, a pair of paper discharge rollers 63, a paper discharge motor 64, and a paper discharge tray 65.

The switch portion 61 switches the transfer routes of the sheet paper P between the paper discharge route RD and the reverse route RR. The switch portion 61 is arranged on a branch point of the paper discharge route RD and the reverse route RR.

The solenoid 62 drives the switch portion 61.

The paper discharge rollers 63 transfer the sheet of paper P, which is directed to the paper discharge route RD by the switch portion 61, to discharge the sheet of paper P to the paper discharge tray 65. The paper discharge rollers 63 are arranged between the switch portion 61 and the paper discharge tray 65 along the paper discharge route RD.

The paper discharge motor 64 rotates to drive the paper discharge rollers 63.

The discharged sheet of paper P is placed on the paper discharge tray 65. The paper discharge tray 65 is arranged at the downward end of the paper discharge route RD.

The reverse unit 6 reverses and refeeds a one-side printed sheet of paper P to the print unit 3 in double-side printing. The reverse unit 6 includes a pair of reverse rollers 66, a reverse motor 67, a pair of paper refeed rollers 68, a paper refeed motor 69, and a switch gate 70.

The reverse rollers 66 switch back the sheet of paper P transferred by the horizontal transfer rollers 58 and transfer the sheet of paper P to the paper refeed rollers 68. The reverse rollers 66 are arranged downstream of the most downstream pair of horizontal rollers 58 along the reverse route RR.

The reverse motor 67 rotates to drive the reverse rollers 66.

The paper refeed rollers 68 transfer the sheet of paper P to the resist rollers 41, which is switched back by the reverse rollers 66 to have its back and front turned. The paper refeed rollers 68 are arranged between the reverse rollers 66 and the resist rollers 41 on the reverse route RR.

The paper refeed motor 69 rotates to drive the paper refeed rollers 68.

The switch gate 70 directs the sheet of paper P to the reverse rollers 66, which is transferred by the horizontal transfer rollers 58. Moreover, the switch gate 70 directs the sheet of paper P to the paper refeed rollers 68, which is switched back by the reverse rollers 66. The switch gate 70 is arranged near the center of gravity of three points of the most downstream pair of horizontal transfer rollers 58, the reverse rollers 66, and the paper refeed rollers 68.

The controller 7 controls operations of the whole of the printing machine 1. As shown in FIG. 4, the controller 7 includes a main controller 71, and a mechanical controller 72.

The main controller 71 takes charge of controlling the whole of the printing machine 1. The main controller 71 includes a CPU (Central Processing Unit) 76, memory 77, an HDD (Hard Disk Drive) 78, an external I/F (interface) 79, a mechanical controller I/F 80, and a head controller 81.

The CPU 76 performs various control processing by performing various programs. The memory 77 is used as a working area of the CPU 76 for a temporary data saving or calculating. The HDD 78 stores various programs and the like. The external I/F 79 transmits and receives data to and from external devices through a network. The mechanical controller I/F 80 connects the mechanical controller 72 to the main controller 71. The head controller 81 controls driving of the inkjet heads 44A to 44D.

The mechanical controller 72 controls the paper feed unit 2, the belt platen unit 43, the upper transfer unit 4, the paper discharge unit 5, and the reverse unit 6 to make them transfer the sheet of paper P. The mechanical controller 72 includes a CPU 86, a memory 87, a main controller I/F 88, a sensor I/F 89, an elevator motor driver 90, a pickup motor driver 91, a resist motor driver 92, a belt platen motor driver 93, an ascent transfer motor driver 94, a horizontal transfer motor driver 95, a solenoid driver 96, a paper discharge motor driver 97, a reverse motor driver 98, and a paper refeed motor driver 99.

The CPU 86 performs various control processing for transferring the sheet of paper P. The memory 87 is used as a working area of the CPU 86 for storing temporary data or calculating. The main controller I/F 88 connects the mechanical controller 72 to the main controller 71. The sensor I/F 89 connects the upper limit sensor 17 and the lower limit sensor 18 to the mechanical controller 72.

The elevator motor driver 90 drives the elevator motor 12. The elevator motor driver 90 has a well-known constant current control function. The constant current control function is a function to control a current flowing to a motor such that the current does not exceed a defined current limit value.

The pickup motor driver 91, the resist motor driver 92, and the belt platen motor driver 93 drive the pickup motor 15, the resist motor 42, and the belt platen motor 51, respectively. The ascent transfer motor driver 94, the horizontal transfer motor driver 95, and the solenoid driver 96 drive the ascent transfer motor 57, the horizontal transfer motor 59, and the solenoid 62, respectively. The paper discharge motor driver 97, the reverse motor driver 98, and the paper refeed motor driver 99 drive the paper discharge motor 64, the reverse motor 67, and the paper refeed motor 69, respectively.

The mechanical controller 72 controls the elevator motor 12 to perform a positioning operation of the paper feed tray 11, when staring a paper feed operation to feed paper to the print unit 3 by picking up the sheet of paper P one by one from the bundle of paper PB on the paper feed tray 11 by the paper feed roller unit 14. The positioning operation is an operation to drive the elevator motor 12 to raise the paper feed tray 11 from when the upper limit sensor 17 is in the off-state till the upper limit sensor 17 is brought into the on-state such that the top position of the bundle of paper PB on the paper feed tray 11 is arranged at the paper feed position, thereby making the paper feed possible.

The mechanical controller 72 controls the elevator motor 12 by setting a current limit in the positioning operation such that a current flowing to the elevator motor 12 does not exceed a current limit value, as will be described later. Here, the mechanical controller 72 uses the constant current control function that the elevator motor driver 90 has and sets the current limit to the elevator motor 12.

After the upper limit sensor 17 is brought into the on-state by the positioning operation, the mechanical controller 72 performs a paper feed position following operation of the paper feed tray 11 by controlling the elevator motor 12, while performing the paper feed operation using the paper feed roller unit 14. The paper feed position following operation is an operation to keep the top position of the bundle of paper PB on the paper feed tray 11 to the paper feed position during the paper feed operation. Specifically, the paper feed position following operation is an operation to drive the elevator motor 12 when the upper limit sensor 17 is brought into the off-state during the paper feed operation, to raise the paper feed tray 11 until the upper limit sensor 17 is brought into the on-state.

The mechanical controller 72 controls the elevator motor 12 without setting the current limit in the paper feed position following operation when a paper feed interval of the sheets of paper P, which are continuously fed by the paper feed unit 2 in the paper feed operation, is below a threshold, as will be described later. On the other hand, when the paper feed interval is equal to or larger than the threshold, the mechanical controller 72 controls the elevator motor 12 with setting the current limit in the paper feed position following operation, as well as in the positioning operation. Here, the paper feed interval is a time interval from when a rear end of a preceding sheet of paper P among continuously fed sheets of papers P goes out the scraper roller 31 till paper feed of the next sheet of paper P is started.

Operations of the printing machine 1 will be described below.

When the main controller 71 receives a print job from the external I/F 79, the CPU 76 of the main controller 71 separates the print job into job data and compressed image data. The CPU 76 then transmits the job data to the mechanical controller 72 and expands the compressed image data. The job data here includes a size of a sheet of paper, the number of sheets to be printed, a setting of one-side printing or double-side printing, a speed of printing (low speed/high speed printing), and the like.

When receiving the job data, the mechanical controller 72 first performs the positioning operation of the paper feed tray 11 by controlling the paper feed unit 2. Details of the positioning operation will be described later.

When the positioning operation ends, the mechanical controller 72 controls the paper feed unit 2, the belt platen unit 43, the upper transfer unit 4, the paper discharge unit 5, and the reverse unit 6 on the basis of the job data to make them transfer the sheet of paper P.

By this transfer control, the mechanical controller 72 performs the paper feed operation of the paper feed unit 2, and thus the sheet of paper P is fed one by one from the paper feed unit 2 to the print unit 3. It is noted that the above-described paper feed position following operation is performed at the paper feed unit 2 during the paper feed operation. Details of the paper feed operation and the paper feed position following operation will be described later.

The sheet of paper P, which is fed from the paper feed unit 2 toward the print unit 3, hits against the resist rollers 41, and skew thereof is corrected. Then the sheet of paper P is sent by the resist rollers 41 toward the belt platen unit 43 and transferred by the belt platen unit 43. On this occasion, the head controller 81 controls the inkjet heads 44A to 44D on the basis of the image data to make them perform printing on the sheet of paper P transferred by the belt platen unit 43. After the printing, the sheet of paper P is transferred from the belt platen unit 43 toward the upper transfer unit 4 where the sheet of paper P is transferred by the ascent transfer rollers 56 and the horizontal transfer rollers 58.

In one-side printing, the sheet of paper P is directed from the common route RC to the paper discharge route RD by the switch portion 61 of the paper discharge unit 5. Then the sheet of paper P is discharged to the paper discharge tray 65 by the paper discharge rollers 63.

In double-side printing, the sheet of paper P is directed from the common route RC to the reverse route RR by the switch portion 61. The sheet of paper P directed to the reverse route RR is directed to the reverse rollers 66 by the switch gate 70 and switched back by the reverse rollers 66 at the reverse unit 6. The switched back sheet of paper P is directed to the paper refeed rollers 68 by the switch gate 70. Then the sheet of paper P is transferred by the paper refeed rollers 68 to the resist rollers 41 and transferred by the resist rollers 41 to the belt platen unit 43.

On this occasion, the sheet of paper P has its back and front turned, so that a non-printed surface is up. While the sheet of paper P is transferred by the belt platen unit 43, the non-printed surface of the sheet of paper P is printed by ink drops discharged from the inkjet heads 44A to 44D. Then the double-side printed sheet of paper P is transferred by the upper transfer unit 4 to the paper discharge unit 5 and discharged to the paper discharge tray 65 at the discharge unit 5.

Here, the double-side printing in the printing machine 1 is performed in an interleaf method. The interleaf method is a method to perform printing alternately on a surface of a non-printed sheet of paper P and on a back of a one-side printed sheet of paper P, while transferring a plurality of sheets of paper P on the transfer routes. This achieves productivity per one side same as that in one-side printing.

In the interleaf method, a non-printed sheet of paper P fed by the paper feed unit 2 and a one-side printed sheet of paper P re-fed by the reverse unit 6 are alternately transferred to the print unit 3. For this reason, the paper feed interval of respective sheets of paper P in the paper feed operation of the paper feed unit 2 in the double-side printing is twice as long as that in the one-side printing.

Moreover, it is possible in the printing machine 1 to select high-speed printing or low-speed printing as a setting of the speed of printing. In the high-speed printing, the transfer speed of the sheets of paper P by the belt platen unit 43 and the paper feed interval by the paper feed unit 2 are set such that the productivity of prints becomes the maximum. The low-speed printing is for printing with suppressing noise compared with the high-speed printing. In the low-speed printing, the transfer speed of the sheet of paper P by the belt platen unit 43 is set slower and the paper feed interval by the paper feed unit 2 is set longer than those of the high-speed printing.

The above-described positioning operation of the paper feed tray 11 will be described below with reference to the flowchart in FIG. 5.

Here, before the positioning operation is started, the paper feed tray 11 is at the lower limit position, the lower limit sensor is in the on-state, and the upper limit sensor 17 is in the off-state. Alternatively, the paper feed tray 11 may be at a position where both of the lower limit sensor 18 and the upper limit sensor 17 are in the off-state.

Figure 5:
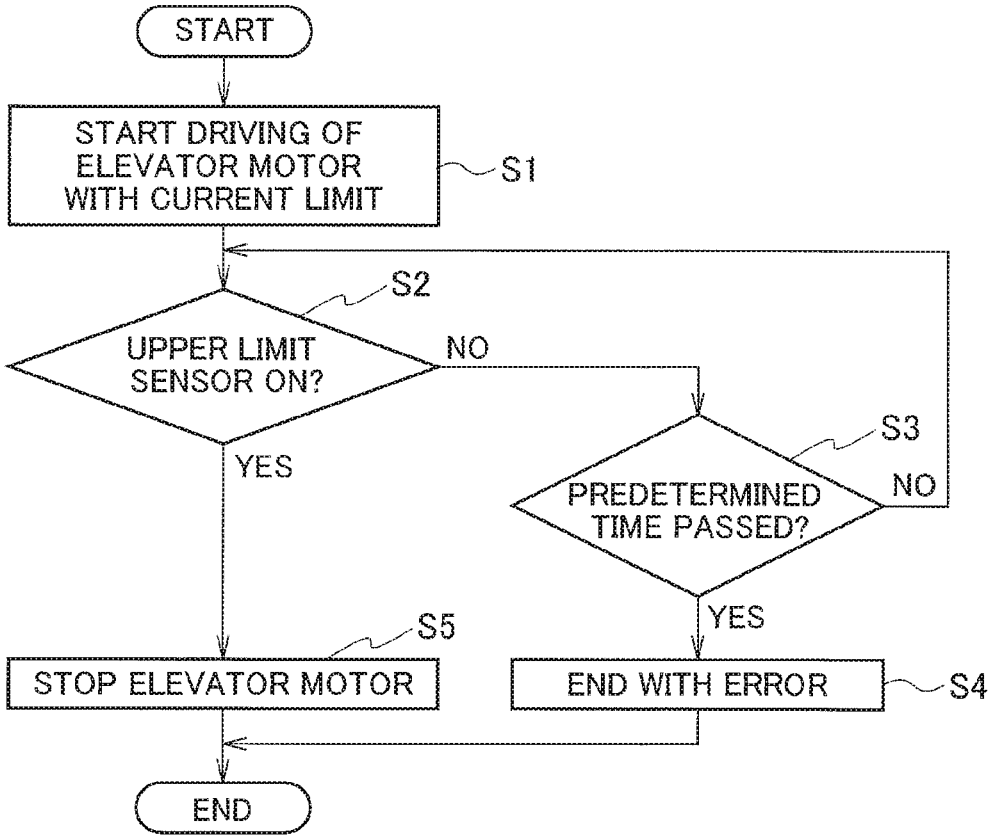
FIG. 5 is a flowchart of a positioning operation of a paper feed tray according to the exemplary embodiment.

In step S1 in FIG. 5, the CPU 86 of the mechanical controller 72 starts driving of the elevator motor 12 in the forward direction. This rotates the shaft 24 of the driving mechanism 13 to start raising of the shaft 24. At the same time, this starts raising of the paper feed tray 11.

Here, when driving the elevator motor 12 in the positioning operation, the CPU 86 sets a current limit to the elevator motor 12. Specifically, the CPU 86 sets a current limit value to the elevator motor 12 using a constant current control function that the elevator motor driver 90 has. This allows the elevator motor driver 90 to control a current flowing to the elevator motor 12 such that the current does not exceed the current limit value even if a load current increases by the increase of load on the elevator motor 12.

The current limit value to the elevator motor 12 is set to a current value at which torque generated by the elevator motor 12 is smaller than torque that damages at least one of the worm gear 21 and the idler gear 22. Moreover, the current limit value to the elevator motor 12 is set to a current value within a range to allow the elevator motor 12 to generate torque to raise the paper feed tray 11 even when the number of sheets of paper P placed on the paper feed tray 11 is the maximum number of sheets and the size of the sheets is the maximum size printable in the printing machine 1.

After starting the driving of the elevator motor 12, in step S2, the CPU 86 determines whether the upper limit sensor 17 is brought into the on-state, or not.

When the CPU 86 determines that the upper limit sensor 17 is in the off-state (step S2: NO), in step S3, the CPU 86 determines whether a predetermined time has passed since the driving of the elevator motor 12 is started, or not. The predetermined time is previously set as a time to determine whether an error occurs while the paper feed tray 11 is raised, or not.

Here, errors in raising the paper feed tray 11 include an error due to a trouble in the upper limit sensor 17, and an error due to a mistake of placing the sheets of paper P, for example. The error due to a trouble in the upper limit sensor 17 is an error that the upper limit sensor 17 is not brought into the on-state due to a trouble although the top position of the bundle of paper PB on the paper feed tray 11 reaches the paper feed position. The error due to a mistake of placing the sheets of paper P is an error that the sheet of paper P placed on the paper feed tray 11 is slipped to the left, and thus the sheet of paper P does not hit the scraper roller 31, so that the upper limit sensor 17 is not brought into the on-state although the top position of the bundle of paper PB on the paper feed tray 11 reaches the paper feed position.

When determining that the predetermined time has not passed since the driving of the elevator motor 12 is started (step S3: NO), the CPU 86 goes back to processing in step S2.

When determining that the predetermined time has passed since the driving of the elevator motor 12 is started (step S3: YES), in step S4, the CPU 86 stops the driving of the elevator motor 12 to end the positioning operation with an error.

Here, when the above-described error due to a trouble in the upper limit sensor 17 occurs, the driving of the elevator motor 12 is continued until the processing ends with an error, although the uppermost sheet of paper P on the paper feed tray 11 hits the scraper roller 31 and thus further raising of the paper feed tray 11 is prevented. When the error due to a mistake of placing the sheet of paper P occurs, the driving of the elevator motor 12 is continued until the processing ends with an error, although the uppermost sheet of paper P on the paper feed tray 11 hits a member (not shown) in the printing machine 1 and thus further raising of the paper feed tray 11 is prevented. When the driving of the elevator motor 12 is continued while the raising of the paper feed tray 11 is prevented, the load on the elevator motor 12 increases, and thus the load current flowing to the elevator motor increases.

Regarding this occasion, the current limit is set to the elevator motor 12 in the positioning operation as described above. That is, even if the load on the elevator motor 12 increases, the current flowing to the elevator motor 12 is controlled such that the current does not exceed the above-described current limit value. This controls the generation of torque to a degree not to damage the worm gear 21 and the idler gear 22, even if the elevator motor 12 tries to rotate while the raising of the paper feed tray 11 is prevented and thus the idler gear 22 does not rotate. Accordingly, this prevents the worm gear 21 and the idler gear 22 from being damaged.

In step S2, when determining that the upper limit sensor 17 is brought into the on-state (step S2: YES), in step S5, the CPU 86 stops the elevator motor 12. Accordingly, the paper feed tray 11 stops while the top position of the bundle of paper PB on the paper feed tray 11 is arranged at the paper feed position, and thus the positioning operation ends.

The above-described paper feed operation and paper feed position following operation at the paper feed unit 2 will be described below with reference to the flowchart in FIG. 6.

When the top position of the bundle of paper PB on the paper feed tray 11 is arranged at the paper feed position and the upper limit sensor 17 is brought into the on-state through the above-described positioning operation, the CPU 86 starts the paper feed operation and the paper feed position following operation at the paper feed unit 2.

Figure 6:
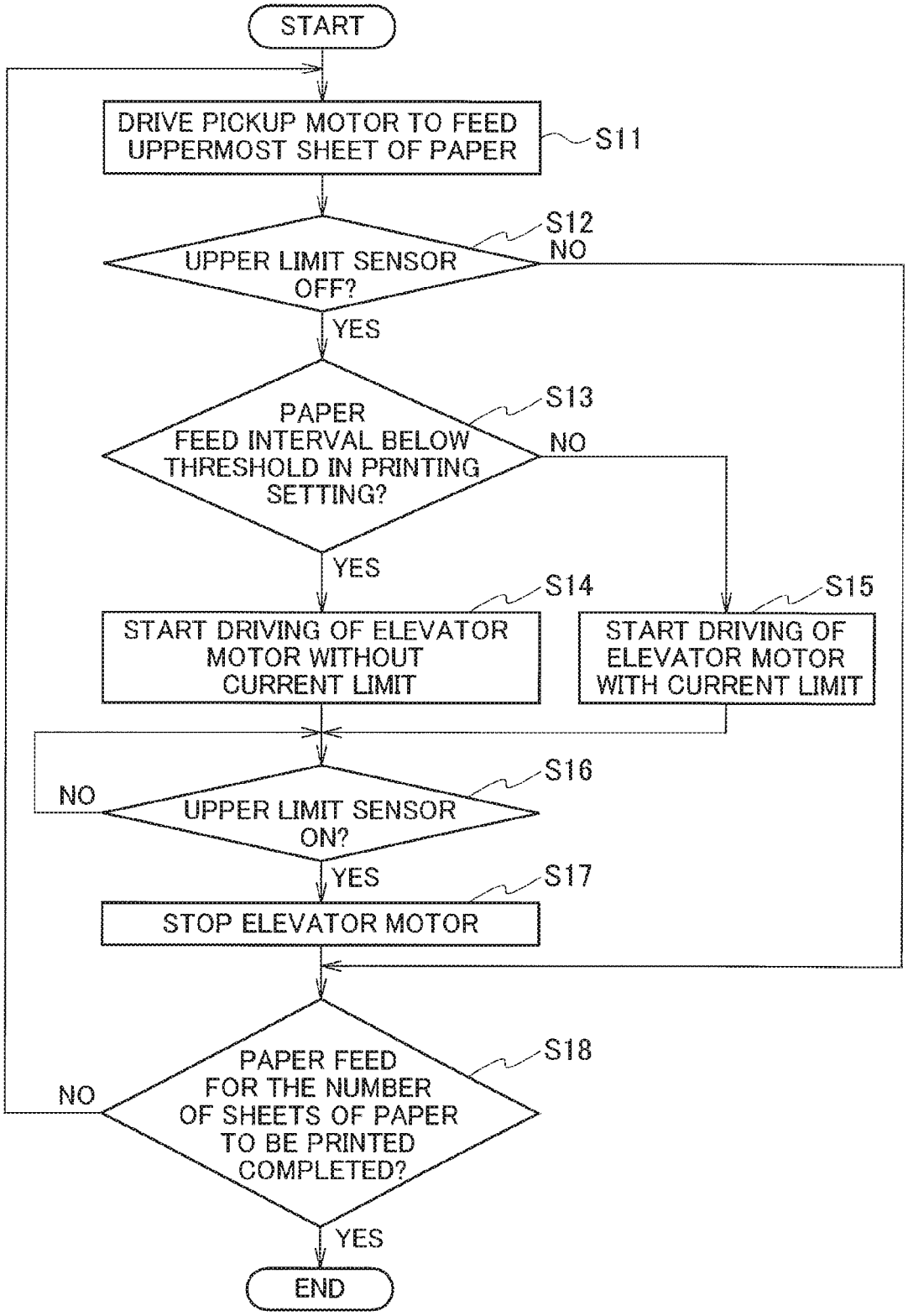
FIG. 6 is a flowchart of a paper feed operation and a paper feed position following operation at a paper feed unit according to the exemplary embodiment.

First, in step S11 in FIG. 6, the CPU 86 drives the pickup motor 15, so that the pickup motor 15 rotates to drive the scraper roller 31 and the pickup roller 32 to feed the uppermost sheet of paper P on the paper feed tray 11 to the print unit 3.

In step S12, the CPU 86 determines whether the upper limit sensor 17 is brought into the off-state, or not.

When determining that the upper limit sensor 17 is brought into the off-state (step S12: YES), in step S13, the CPU 86 determines whether a paper feed interval in the paper feed operation at the paper feed unit 2 is below a threshold in a printing setting.

Here, the threshold of the paper feed interval is a value to determine whether or not the raising of the paper feed tray 11 compensates for the descending of the top position of the bundle of paper PB on the paper feed tray 11 by the paper feed operation when the current limit is set to the elevator motor 12 in the paper feed position following operation as well as in the positioning operation. That is, the threshold of the paper feed interval is a value to determine whether or not the paper feed tray 11 is raised such that the top position of the bundle of paper PB on the paper feed tray 11 reaches the paper feed position from when the upper limit sensor 17 is brought into the off-state until a timing of next paper feed in the paper feed position following operation with the current limit set to the elevator motor 12.

Printing settings with the paper feed interval equal to or larger than the threshold include a low-speed printing setting. Moreover, even with a high-speed printing setting, the paper feed interval is equal to or larger than the threshold in a setting of double-side printing with the length of a sheet in a transfer direction equal to or longer than a predetermined length. Printing settings other than the printing settings with the paper feed interval equal to or larger than the threshold have the paper feed interval below the threshold.

When determining that the paper feed interval is below the threshold in the printing setting (step S13: YES), in step S14, the CPU 86 starts driving of the elevator motor 12 in the forward direction without the current limit.

When determining that the paper feed interval is equal to or larger than the threshold in the printing setting (step S13: NO), in step S15, the CPU 86 starts driving of the elevator motor 12 in the forward direction with the current limit. The current limit value of the elevator motor 12 here is same as that in the above-described positioning operation.

Here, when the current limit is set to the elevator motor 12 in the paper feed position following operation as well as in the positioning operation, the torque generated by the elevator motor 12 is controlled to suppress the raising speed of the paper feed tray 11. Accordingly, when the paper feed interval is below the threshold, the raising of the paper feed tray 11 in the paper feed position following operation may not compensate for the descending of the top position of the bundle of paper PB on the paper feed tray 11 by the paper feed operation, which may cause a trouble in the paper feed. To avoid such a paper feed trouble, when the paper feed interval is below the threshold, the current limit is not set to the elevator motor 12 in the paper feed position following operation.

Moreover, in the positioning operation performed before the paper feed operation is started, as the upper limit sensor 17 is in the on-state, it is determined that there is no trouble in the upper limit sensor 17 and no mistake of placing the sheets of paper P on the paper feed tray 11 as described above. That is, it is determined that the error that the upper limit sensor 17 is not brought into the on-state although the top position of the bundle of paper PB on the paper feed tray 11 reaches the paper feed position, hardly occurs in the paper feed position following operation. Accordingly, need for setting the current limit to the elevator motor 12 to prevent the worm gear 21 and the idler gear 22 from being damaged is low in the paper feed position following operation. For this reason, when the paper feed interval is below the threshold, it is possible not to set the current limit to the elevator motor 12 in the paper feed position following operation, as described above.

On the other hand, when the paper feed interval is equal to or larger than the threshold, the raising of the paper feed tray 11 compensates for the descending of the top position of the bundle of paper PB on the paper feed tray 11 by the paper feed operation even if the current limit is set to the elevator motor 12 in the paper feed position following operation.

Then, when the paper feed interval is equal to or larger than the threshold, the current limit to the elevator motor 12 is set in the paper feed position following operation, as well as in the positioning operation. This prevents the worm gear 21 and the idler gear 22 from being damaged even if the upper limit sensor 17 is not brought into the on-state due to a trouble therein in the paper feed position following operation, and the driving of the elevator motor 12 is continued while the raising of the paper feed tray 11 is prevented by the scraper roller 31.

In step S14 or step S15, after starting the driving of the elevator motor 12, in step S16, the CPU 86 determines whether the upper limit sensor 17 is brought into the on-state, or not. When determining that the upper limit sensor 17 is in the off-state (step S16: NO), the CPU 86 repeats step S16.

When determining that the upper limit sensor 17 is brought into the on-state (step S16: YES), in step S17, the CPU 86 stops the elevator motor 12. This stops the paper feed tray 11 while the top position of the bundle of paper PB on the paper feed tray 11 is arranged at the paper feed position. Then the CPU 86 proceeds to processing in step S18.

Moreover, in step S12, when determining that the upper limit sensor 17 is in the on-state (step S12: NO), the CPU 86 omits steps S13 to S17 and proceeds to processing in step S18.

In step S18, the CPU 86 determines whether the paper feed for the number of sheets of paper to be printed is completed, or not. When determining that the paper feed for the number of sheets of paper to be printed is not completed (step S18: NO), the CPU 86 goes back to the processing in step S11. When determining that the paper feed for the number of sheets of paper to be printed is completed (step S18: YES), the CPU 86 finishes the paper feed operation and the paper feed position following operation at the paper feed unit 2.

As described above, in the printing machine 1, when starting the paper feed operation, the mechanical controller 72 performs the positioning operation with setting the current limit such that the current flowing to the elevator motor 12 does not exceed the current limit value.

This controls the generation of torque in the positioning operation to the degree not to damage the worm gear 21 and the idler gear 22 even if the elevator motor 12 tries to rotate while the paper feed tray 11 is prevented from being raised by the error due to a trouble in the upper limit sensor 17, or the like. This prevents the worm gear 21 and the idler gear 22 from being damaged.

Moreover, the paper feed operation and the paper feed position following operation are performed after the upper limit sensor 17 is brought into the on-state by the positioning operation. This reduces the occurrence of the error due to a trouble in the upper limit sensor 17 or the like in the paper feed position following operation. Accordingly, this reduces the possibility of the worm gear 21 and the idler gear 22 damaged due to the continuation of the driving of the elevator motor 12 while the paper feed tray 11 is prevented from being raised due to a trouble in the upper limit sensor 17 or the like in the paper feed position following operation.

Moreover, in the paper feed position following operation performed during the paper feed operation after the positioning operation, the mechanical controller 72 controls the elevator motor 12 without setting the current limit when the paper feed interval is below the threshold. Accordingly, the torque generated by the elevator motor 12 is not controlled with the current limit. Accordingly, the raising of the paper feed tray 11 compensates for the descending of the top position of the bundle of paper PB on the paper feed tray 11 by the paper feed operation although the paper feed interval is below the threshold, thereby preventing the paper feed trouble.

According to the printing machine 1, it is thus possible to prevent the device from being damaged and to prevent the paper feed trouble.

Moreover, the mechanical controller 72 controls the elevator motor 12 with setting the current limit in the paper feed position following operation when the paper feed interval is equal to or larger than the threshold. This prevents the worm gear 21 and the idler gear 22 from being damaged even if the trouble in the upper limit sensor 17 occurs in the paper feed position following operation when the paper feed interval is equal to or larger than the threshold. Accordingly, this prevents the printing machine 1 from being damaged.

It is noted that the elevator motor 12 may be controlled without the current limit in the paper feed position following operation regardless of the paper feed interval. Even in this case, the current limit is set to the elevator motor 12 in the positioning operation. The worm gear 21 and the idler gear 22 are thus prevented from being damaged as described above. Moreover, the paper feed operation and the paper feed position following operation are performed after the upper limit sensor 17 is brought into the on-state in the positioning operation. This reduces the occurrence of the error due to a trouble in the upper limit sensor 17 in the paper feed position following operation as described above. Accordingly, this reduces the possibility of the worm gear 21 and the idler gear 22 damaged by the error due to a trouble in the upper limit sensor 17 or the like in the paper feed position following operation. Moreover, the torque generated by the elevator motor 12 is not controlled with the current limit in the paper feed position following operation. Accordingly, the raising of the paper feed tray 11 compensates for the descending of the top position of the bundle of paper PB on the paper feed tray 11 by the paper feed operation. This prevents the paper feed trouble. Accordingly, it is possible to prevent the printing machine 1 from being damaged and to prevent the paper feed trouble.

Moreover, the current limit value set to the elevator motor 12 may be adjusted according to the size of the sheet of paper P placed on the paper feed tray 11. Specifically, as the size of the sheet of paper P becomes smaller, the current limit value may be set larger. This prevents the raising speed of the paper feed tray 11 from decreasing due to an excessive current limit against the weight of the sheets of paper P placed on the paper feed tray 11 and shortens the time required for the positioning operation.

The present invention is not limited to the above described exemplary embodiment and may be embodied with the structural components modified within a scope not deviating from the gist of the present invention in the stage of carrying out the invention. Moreover, it is possible to form various inventions by appropriately combining a plurality of structural components disclosed in the above exemplary embodiment. For example, some structural components may be deleted from the all structural components disclosed in the exemplary embodiment.

The present exemplary embodiment includes the following features, for example.

A paper feed device including: a paper feed tray that is raised and lowered, on which a plurality of sheets of paper is placed; a paper feed roller that picks up a sheet of paper on the top of a bundle of paper on the paper feed tray; a detector that detects that a top position of the bundle of paper on the paper feed tray is at a predetermined paper feed position; a motor that generates a driving force for raising and lowering the paper feed tray; a driving mechanism that transmits the driving force of the motor to the paper feed tray to raise and lower the paper feed tray; and a controller that (i) when starting a paper feed operation to pick up the sheet of paper one by one from the bundle of paper on the paper feed tray by the paper feed roller, drives the motor to perform a positioning operation to raise the paper feed tray from when the detector is in an off-state where the detector does not detect that the top position of the bundle of paper on the paper feed tray is at the paper feed position till the detector is brought into an on-state in which the detector detects that the top position of the bundle of paper on the paper feed tray is at the paper feed position, and (ii) while performing the paper feed operation using the paper feed roller after the detector is brought into the on-state by the positioning operation, when the detector is brought into the off-state, drives the motor to perform a paper feed position following operation to raise the paper feed tray until the detector is brought into the on-state, wherein the controller controls the motor by setting a current limit in the positioning operation such that a current flowing to the motor does not exceed a current limit value and the controller controls the motor without setting the current limit in the paper feed position following operation.

When a paper feed interval in the paper feed operation is equal to or larger than a threshold, the controller controls the motor by setting the current limit in the paper feed position following operation such that a current flowing to the motor does not exceed the current limit value.

What is claimed is:

1. A paper feed device comprising:

a paper feed tray that is raised and lowered, on which a plurality of sheets of paper is placed;

a paper feed roller that picks up a sheet of paper on the top of a bundle of paper on the paper feed tray;

a detector that detects that a top position of the bundle of paper on the paper feed tray is at a predetermined paper feed position;

a motor that generates a driving force for raising and lowering the paper feed tray;

a driving mechanism that transmits the driving force of the motor to the paper feed tray to raise and lower the paper feed tray; and a controller that (i) when starting a paper feed operation to pick up the sheet of paper one by one from the bundle of paper on the paper feed tray by the paper feed roller, drives the motor to perform a positioning operation to raise the paper feed tray from when the detector is in an off-state where the detector does not detect that the top position of the bundle of paper on the paper feed tray is at the paper feed position till the detector is brought into an on-state in which the detector detects that the top position of the bundle of paper on the paper feed tray is at the paper feed position, and (ii) while performing the paper feed operation using the paper feed roller after the detector is brought into the on-state by the positioning operation, when the detector is brought into the off-state, drives the motor to perform a paper feed position following operation to raise the paper feed tray until the detector is brought into the on-state, wherein the controller controls the motor by setting a current limit in the positioning operation such that a current flowing to the motor does not exceed a current limit value at which a torque generated by the motor is smaller than a torque that can damage the driving mechanism that transmits the driving force of the motor to the paper feed tray to raise and lower the paper feed tray, and the controller controls the motor without setting the current limit in the paper feed position following operation.

2. The paper feed device according to claim 1, wherein when a paper feed interval in the paper feed operation is equal to or larger than a threshold, the controller controls the motor by setting the current limit in the paper feed position following operation such that a current flowing to the motor does not exceed the current limit value.

3. A paper feed device comprising:

a paper feed tray that is raised and lowered, on which a plurality of sheets of paper is placed;

a paper feed roller that picks up a sheet of paper on the top of a bundle of paper on the paper feed tray;

a detector that detects that a top position of the bundle of paper on the paper feed tray is at a predetermined paper feed position;

a motor that generates a driving force for raising and lowering the paper feed tray;

a driving mechanism that transmits the driving force of the motor to the paper feed tray to raise and lower the paper feed tray; and a controller that, when starting a paper feed operation to pick up the sheet of paper one by one from the bundle of paper on the paper feed tray by the paper feed roller, drives the motor to perform a positioning operation to raise the paper feed tray from when the detector is in an off-state where the detector does not detect that the top position of the bundle of paper on the paper feed tray is at the paper feed position till the detector is brought into an on-state in which the detector detects that the top position of the bundle of paper on the paper feed tray is at the paper feed position, wherein the controller controls the motor by setting a current limit in the positioning operation such that a current flowing to the motor does not exceed a current limit value at which a torque generated by the motor is smaller than a torque that can damage the driving mechanism that transmits the driving force of the motor to the paper feed tray to raise and lower the paper feed tray.

* * * * *